United States Patent [19]

Hill

[11] Patent Number: 4,658,436

[45] Date of Patent: Apr. 14, 1987

[54] DISGUISED TRANSMISSION SYSTEM AND METHOD

[75] Inventor: Terrance J. Hill, Fairfield, Ohio

[73] Assignee: Cincinnati Electronics Corporation, Cincinnati, Ohio

[21] Appl. No.: 437,309

[22] Filed: Oct. 28, 1982

[51] Int. Cl.[4] ..... H04K 1/00; H04K 1/06

[52] U.S. Cl. ..... 380/31; 380/54; 380/36

[58] Field of Search ..... 455/26, 52, 67; 375/1, 375/40, 2.1, 2.2; 333/165; 178/22.15; 343/18 E

[56] References Cited

U.S. PATENT DOCUMENTS

| | | | |
|---|---|---|---|
| 3,350,644 | 10/1967 | McNair | 325/58 |
| 3,413,570 | 11/1968 | Bruene et al. | 332/9 |
| 3,432,619 | 3/1969 | Blasbalg | 179/15 |
| 3,475,558 | 10/1969 | Cahn . | |
| 3,713,025 | 1/1973 | McNair | 325/58 |
| 3,891,989 | 6/1975 | Barney et al. | 343/18 E |
| 3,999,005 | 12/1976 | Dickinson | 455/26 |
| 4,032,846 | 7/1977 | Hirade et al. | 375/40 |
| 4,105,958 | 8/1978 | Pierce et al. | 333/165 |
| 4,231,113 | 10/1980 | Blasbalg | 455/29 |
| 4,241,447 | 12/1980 | Epstein | 375/1 |
| 4,255,810 | 3/1981 | Solomon et al. | 455/26 |
| 4,324,002 | 4/1982 | Spilker | 455/26 |
| 4,397,034 | 8/1983 | Cox et al. | 455/26 |
| 4,464,791 | 8/1984 | Eness | 455/67 |
| 4,490,830 | 12/1984 | Kai et al. | 455/52 |

*Primary Examiner*—Salvatore Cangialosi

*Attorney, Agent, or Firm*—Lowe, Price, Leblanc, Becker & Shur

[57] ABSTRACT

Data signals are transmitted at a variable information rate with variable power so the information rate and transmitted power increases and decreases together to simulate high frequency fading and enable the data transmission to be disguised. The information rate and power vary in response to a predictable noiselike function generator.

54 Claims, 6 Drawing Figures

DISGUISED TRANSMISSION SYSTEM AND METHOD

TECHNICAL FIELD

The present invention relates generally to a disguised transmission system and method and more particularly to a disguised transmission system and method wherein the transmitted power and data information rate increase and decrease together to simulate fading.

BACKGROUND ART

In certain situations, it is desirable to enable data to be transmitted from a particular location in such a manner as to be disguised from receivers in the vicinity. In particular, personnel in hostile territory frequently desire to transmit a data signal to a remote, friendly receiver without detection by enemy receivers in the vicinity of the transmission site. Such a transmission scheme is desirably employed by military personnel, in behind the front activities, from portable transmitters, such as "man packs", or by clandestine "civilian" personnel from fixed transmission sites. It is also desirable for a transmitter for such purposes to be relatively jam proof and for the data signal to be coded, to decrease the possibility of deciphering a message, in the event that the disguised signal is detected.

DISCLOSURE OF THE INVENTION

In accordance with the present invention, a disguised signal transmission system and method involves transmitting a data signal at a variable information rate with variable power so the information rate and transmitted power increase and decrease together and the transmitted data signal simulates fading. Fading is particularly simulated in high frequency (i.e., 3–30 MHz) transmission links because of the ionospheric high frequency fading effect. A hostile surveillance receiver in the vicinity of the transmitter that picks up the transmitted, disguised signal detects the signal as if it were transmitted from a great distance. Hence, the surveillance receiver does not attempt to jam the transmitted signal because the transmitted signal appears to be at a sufficiently great distance that it can not be jammed. Thereby, the transmitter and the personnel associated therewith are not detected by personnel associated with the hostile surveillance receiver.

In one embodiment, the transmitted data signal includes a series of data bits, each having the same energy by virtue of the product of the power and duration of every bit being constant. A transmitter in accordance with this embodiment includes a generator for deriving a pseudo-random sequence having a predetermined chip rate. In response to the sequence derived from the generator, a signal indicative of the number, K, of chips of the sequence for each data bit is derived. The value of K is an integral submultiple of the number of chips derived from the sequence in a predetermined interval. In response to the sequence and the signal indicative of K, a data bit from a source of information data bits is clocked each time the number of bits in the sequence equals K. Transmitter means, preferably in the high frequency band, derives an angle modulated wave, i.e., frequency modulated or phase modulated, having a modulation extent controlled by the clock bits and having a variable power level proportional to K. The transmitter means is responsive to a signal derived from an EXCLUSIVE OR gate means responsive to the clocked data bits and the sequence. Because the value of K is an integral submultiple of the number of chips derived from the sequence, transitions from the EXCLUSIVE OR gate means are synchronized with transitions from the sequence.

A receiver for the disguised wave demodulates the wave to derive a base band replica of the binary data bits supplied to the receiver with an occurrence rate determined by the sequence. A generator of the pseudo-random sequence is synchronized to derive a synchronized sequence. EXCLUSIVE OR gate means responsive to the synchronized sequence and the base band replica derives a first signal, which in a perfect noiseless link has a value and duration equal to that of every data bit derived from the EXCLUSIVE OR gate means at the transmitter. In response to the base band replica, a second signal having a value indicative of K is derived. An accumulator adds the binary values of the output of the gate means at the receiver over an interval of K, under the control of the second signal. Because the link is not noiseless the output of the receiver gate means may not correspond accurately with the input of transmitter gate means. To compensate for this possible inaccuracy, the receiver includes a decision means to derive a replica of the binary data bits supplied by the data source to the transmitter.

In the previously discussed embodiment K chips, each having the same power, are transmitted during each data bit. After one data bit has been transmitted, the transmitter power under most circumstances suddenly changes to a new power level for the next transmitted data bit, having a duration of K′ chips. Such sudden changes in the power level can likely be used by intelligent surveillance receivers to identify the transmitter, unless a very large number of discrete power and data bit duration levels are employed, in turn implying a very large number of bits in the transmitter digital hardware. A second disadvantage of maintaining the energy per transmitted bit absolutely constant is that there is a very unnatural power versus time relationship. High power portions of the transmission are skewed toward being shorter than the lower power, i.e., faded, portions. Thus, the high power portions result in a burst like transmission.

To obviate these disadvantages of the first named embodiment, a second embodiment of the invention provides for minor energy variations during each data bit, enabling the transmitted signal power to match Rayleigh or other fading statistics exactly without quantizing the transmitted power levels. To provide the Rayleigh or other fading statistics without quantizing the power level, a digital noise generator derives a sequence which serves as a fading waveform source. The particular statistics and spectral characteristics of the digital noise source are not important as long as they simulate Rayleigh or other fading characteristics, but the noise source characteristics must be predetermined to enable a receiver to detect the transmitted variable duration and amplitude data bits; both the amplitude and duration of the transmitted data bits are controlled by the fading waveform source.

A dynamic digital low pass filter responds to the digital noise generator to transform the noise generator sequence into a smooth function of time. The dynamic digital low pass filter provides a first-order approximation of the fading characteristics of a high frequency channel. For typical high frequency channels, the filter has a cut-off frequency in the range of 0.5 to 2.0 Hertz. To provide the most realistic simulation of high frequency fading, the bandwidth of the low pass filter is changed during operation by changing the filter coefficients.

A receiver for the transmitted signal includes digital noise sequence generator circuitry and dynamic digital low pass filter circuitry having identical characteristics with those of the transmitter. The characteristics of the receiver noise source and low pass filter are synchronized with those of the transmitter.

The output of the dynamic digital low pass filter typically has a nearly Gaussian probability. The nearly Gaussian probability output of the digital low pass filter is mapped to a density function which represents high frequency fading. If the transmitted power is directly controlled, a chi-square controller, having two degrees of freedom, determines the amplitude of the transmitted power. However, if the transmitted power is varied directly by controlling the voltage of the transmitter, a Rayleigh distribution controls the amplitude of the transmitter power. To convert a chi-square distribution into a Rayleigh distribution, it is merely necessary to determine the square root of the chi-square distribution. Because of the relatively low frequency nature of the Rayleigh and chi-square distributions relative to the duration of a transmitted data bit, only minor power variations can occur over the length of a transmitted data bit.

To enable the duration of the transmitted data bits to be approximately inversely related to the amplitude of the power in the data bits, the density function representing fading controls the duration of each bit. To this end, the density function representing fading is applied as an address input to a read only memory which maps values of the density function representing fading into the number of pseudo noise chips included in a single transmitted data bit. The read only memory responds to the density function representing fading to produce an output signal representing the number of chips in a data bit, i.e., the read only memory derives a signal indicative of K. As in the first embodiment, a data bit from a source of data bits is clocked each time the number of bits in the sequence equals K. An angle modulated wave having a modulation extent controlled by the clock bits and a variable power level determined by the density function representing fading is transmitted. A receiver responsive to the transmitter functions similarly to that described with regard to the first embodiment, but includes suitable circuitry for determining the duration of each data bit in response to a density function representative of fading. Thereby, the beginning and end of each data bit at the receiver can be determined, for detection purposes.

It is, accordingly, an object of the present invention to provide a new and improved system for and method of enabling data to be transmitted from hostile territory without arousing suspicion of a surveillance receiver in the vicinity of the transmitter.

Another object of the present invention is to provide a transmitter system and method wherein a hostile surveillance receiver responsive to the transmitter detects the transmitter signal in such a manner as to believe that the transmitter is at a sufficiently great distance that the signal can not be jammed.

A further object of the invention is to provide a data communication system and method wherein a wave is modulated with data in such a manner that the wave is disguised with characteristics simulating fading.

Still a futher object of the invention is to provide a transmission system and method wherein a data signal is transmitted at a variable information rate with variable power to simulate fading, particularly ionospheric high frequency fading.

The above and still further objects, features and advantages of the present invention will become apparent upon consideration of the following detailed description of several specific embodiments thereof, especially when taken in conjunction with the accompanying drawing.

BEST MODE FOR CARRYING OUT THE INVENTION

Figure 1:
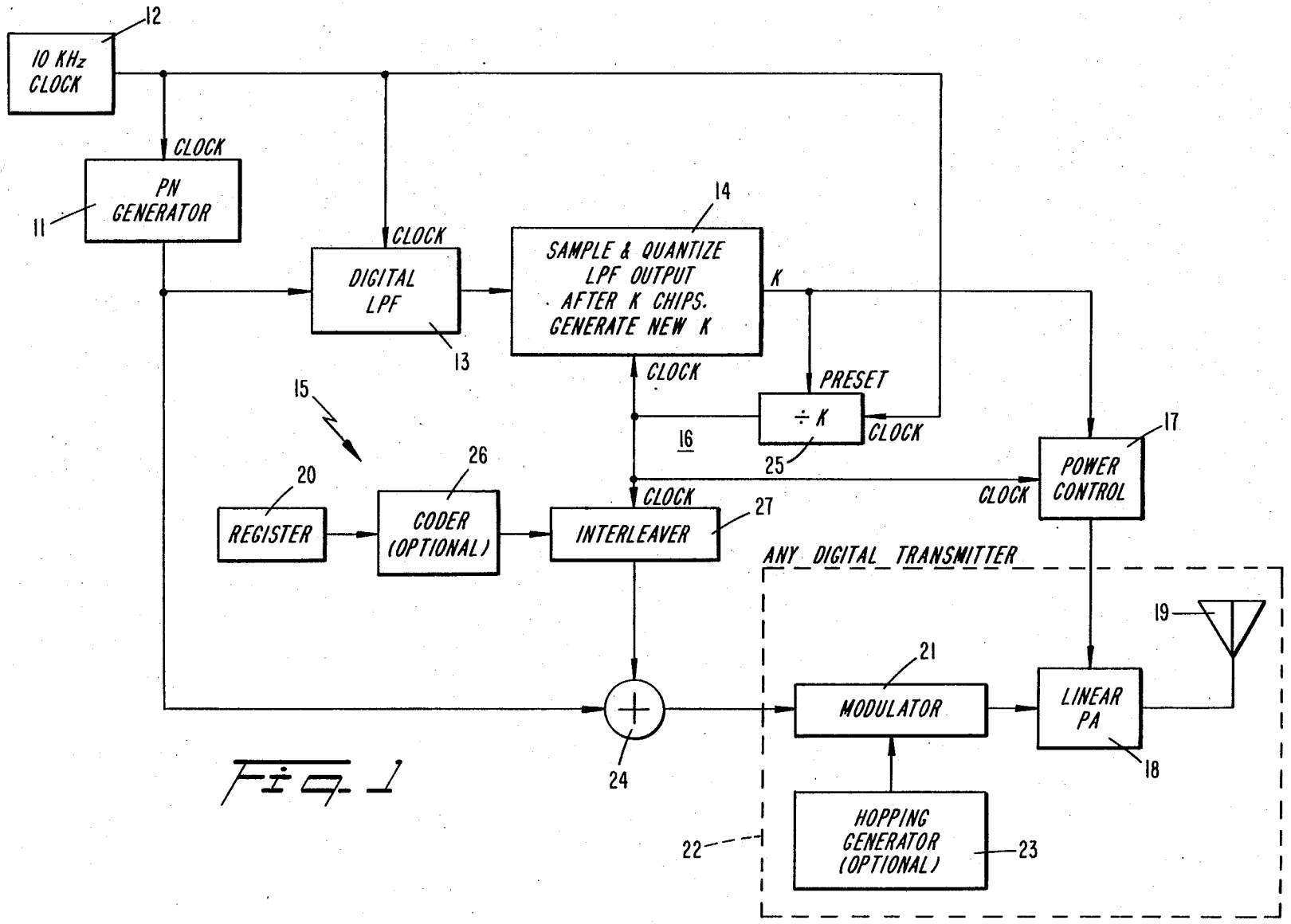
FIG. 1 is a block diagram of one embodiment of a transmitter in accordance with the invention.

Reference is now made to FIG. 1 of the drawing wherein there is illustrated a serial pseudo-random number (PN) generator 11, driven by square wave clock source 12, having a frequency fc. In a preferred embodiment, fc=1-10 kHz, whereby pseudo-random noise generator 11 derives a predictable random sequence having a chip rate of 10 kHz, and the pseudo-random noise generator derives a bit sequence in the range of between $2^{15}-1$ and $2^{30}-1$, depending upon the application. As is well known to those skilled in the art, one chip is derived from PN generator 11 in response to each cycle of source 12. If the bit sequence is in the range of $2^{15}-1$ bits in length, the apparatus of the present invention can be employed for mobile, man pack type devices because the bit sequence is on the order of 3 seconds for a 10 kHz chip rate. For a bit sequence of $2^{30}-1$, the sequence requires approximately 100,000 seconds to complete, for a chip rate of 10 kHz; such a generator is suitable for non-real time communication links wherein a receiver can store a coded binary data sequence resulting from the output of generator 11.

The pseudo-random number sequence derived by generator 11 is applied to digital low pass filter 13, having a clock input responsive to the 10 kHz output of clock source 12. Filter 13 typically has an effective cut-off frequency of 10 Hertz, to provide a receiver correlation time of approximately 100,000 milliseconds. Filter 13 has a relatively low, 10 Hertz cut-off frequency to enable a transmitted wave derived from the transmitter of FIG. 1 to have only relatively small changes in power, to assist in simulating a fading high frequency signal transmitting characteristic. Filter 13 responds to the serial output signal of pseudo-random number generator 11 and clock source 12 to derive a multi-bit, parallel output word once for each cycle of clock 12; typically, each output word of filter 13 includes eight bits, to represent the accumulated value of the output of generator over the previous 0.1 second, i.e. Thus, filter 13 samples eight successive bits from generator 11 and derives a corresponding eight bit parallel output word each time eight clock pulses are derived from clock 12.

The parallel output signal of digital low-pass filter 13 is applied to quantizer 14 which derives a parallel multibit output signal having a variable value K, an integral sub-multiple of the value associated with the output signal of filter 13. The output signal of quantizer 14 is derived after K chips have been derived from PN generator 11. To derive such a quantized signal quantizer 14 includes a buffer register having a number of stages responsive only to the most significant bits in each output word of digital low-pass filter 13. The buffer register stages sample the Kth parallel output word of filter 13 after K chips have been derived from PN generator 11, a result achieved by enabling parallel inputs of the buffer register after K chips have occurred. For the particularly described embodiment, wherein filter 13 derives an eight bit output word, quantizer 14 merely couples the five most significant parallel output bits of filter 13 to five buffer register stages enabled after K chips have been supplied by PN generator 11 to filter 13. The five bit output of quantizer 14 has a signal magnitude K, representing the number of chips of PN generator 11 to be included in each serial data bit derived from binary data source 15.

In a typical situation, binary data source 15 includes a voice to binary encoder (not shown) for deriving a binary data signal representing voice information. Alternatively, binary data source 15 includes a telegraphy or ASCII source. Data bits from the encoder, telegraphy or ASCII source are loaded into buffer register 20, a part of source 15. Register 20 derives a binary serial output signal.

The output signal of quantizer 14, representing the value of K, is applied in parallel to data coding channel 16 and power control network 17 for linear class B or linear class AB power amplifier 18, included in conventional, high frequency (i.e., 3–30 mHz) digital transmitter 22. The value of K controls channel 16 and power controller 17 such that the occurrence rate of bits from data source 15 and the power supplied by amplifier 18 to antenna 19 are always directly proportional to each other, whereby the transmitted power and the bit rate of data from source 15 increase and decrease together in such a manner that the total energy in each transmitted data bit is the same. Thereby, for data derived from channel 16 at a low bit rate, the amount of instantaneous radiated power from antenna 19 is relatively low; for high data bit rates derived from channel 16, the instantaneous power radiated from antenna 19 is relatively high. Because transmitter 22 includes angle modulator 21, i.e., a frequency or phase modulator, the amount of energy per bit remains constant, even though the instantaneous power derived from amplifier 18 is variable over the duration of several transmitted bits.

Power controller 17 controls the amount of power derived from amplifier 18 by varying the voltage applied to a power supply terminal of the amplifier by an amount directly proportional to K. To this end, power controller 17 includes a digital to analog converter responsive to the binary signal indicative of K, as derived from quantizer 14. The voltage output of the digital to analog converter in controller 17 controls the power supply voltage of amplifier 18.

Angle modulator 21 supplies a constant amplitude frequency or phase modulated output signal to amplifier 18. Modulator 21 can also be responsive to a conventional hopping generator 23 which varies the carrier frequency of the constant amplitude wave derived by the angle modulator in a conventional manner to provide an extra measure of anti-jamming protection.

Modulator 21 is responsive to binary bits of data signal 15, as processed by channel 16 and derived at an output of EXCLUSIVE OR gate 24, having one input responsive to the output of channel 16, and a second input directly responsive to the sequence derived from pseudo-random number generator 11. EXCLUSIVE OR gate 24 is a modulo two adder, or the complement thereof for non-linearly combining each binary data bit derived from channel 16 with K pseudo-random chips derived from PN generator 11. EXCLUSIVE OR gate 24 derives a binary output signal having first and second values in response to the two inputs thereof being respectively the same and different.

Channel 16 includes a variable modulus counter or frequency divider 25, having a modulus, i.e., preset, parallel input bus responsive to the parallel output of quantizer 14 representing the value of K. Counter 25 also includes a clock input responsive to the output of clock source 12, whereby counter 25 is incremented by a count of one each time a chip is derived from PN generator 11 by responding to a positive or negative going transition in the output of source 12. In response to the number of chips derived from PN generator 11 reaching the preset value of K, counter 25 derives an output signal which controls clocking of bits from data source 15 to EXCLUSIVE OR gate 24 and enabling of the buffer register in quantizer 14 so it responds to the five most significant output bits of filter 13. Thereby, each time the number of pulses from PN generator 11 is equal to the number K, a data bit from source 15 is supplied to EXCLUSIVE OR gate 24 and a new value of K is supplied to each of power controller 13 and quantizer 14. The clock rate of data from source 15 is quantized to an integral submultiple of the 10 kHz chip rate of pseudo-random number generator 11 to insure that data transitions supplied to EXCLUSIVE OR gate 24 by channel 16 coincide with transitions in the 10 kHz chip rate output of generator 11. When data bits are initially applied by source 15 to channel 16, counter 25 is set to a value in the range of values of K; a typical range for K is 10 to 10,000. Preferably the initial value of K is a predetermined value which prevents initial sudden transitions in the value of K. Such a result can be achieved because the pseudo-random sequence of PN generator 11 is predictable and is always started at the same point in the sequence when data are initially applied by source 15 to channel 16 by conventional reset means, not shown. Thereby, the value of the signal derived from filter 13 during the first chip of a sequence can be determined and is initially set into counter 23.

Data source 15 includes buffer register 20 for storing data bits derived from voice to binary encoder, telegraphy or ASCII source. Data bits from register 20 are serially applied to coder 26, which in turn drives interleaver 27. Coder 26 is employed only if the invention is utilized for secure, cryptographic purposes. In a typical embodiment, coder 26 is a modulo two adder driven by a pseudo-random number generator (not shown) having a chip rate equal to the bit rate of the signal derived from register 20.

The resulting, binary serial output signal of coder 26 is applied to conventional, prior art interleaver 27. In high frequency communication systems, wherein errors have a tendency to occur in a manner that is not necessarily random, interleaving is typically employed. Interleaver 27 selects a number of bits from coder 26 and rearranges them. For example, 100 bits are selected and rearranged so that the first set of ten bits derived from interleaver 27 are bits 10, 20, 30 . . . 100 supplied to the interleaver by coder 26; the second set of ten bits derived from interleaver 27 are bits 1, 11 . . . 91 supplied to the interleaver by coder 26; the third set of ten bits derived from interleaver 27 are bits 2, 12, 22 . . . 92 supplied to the interleaver by coder 26, etc., so that the last set of ten bits derived from interleaver 27 are bits 9, 19, 29 . . . 99 supplied to the interleaver by coder 26. Interleaver 27 includes a clock input responsive to the output signal of counter 25 so that the bits are read from the interleaver to EXCLUSIVE OR gate 24 under the control of each output of the counter. Thus, in the example previously given, interleaver 27 responds to the first ten output pulses of counter 25 that occur at a frequency of $1/K \times f_c$, to supply EXCLUSIVE OR gate 24 with the 10th, 20th, 30th . . . 90th, 100th bits derived from coder 26.

The binary signal derived from EXCLUSIVE OR gate 24 is a pseudo-random sequence modulated by data bits from source 15. The number of chips in the pseudo-random signal derived from exclusive OR gate 24 for each bit of data source 15 is randomly variable and equal to K. As described supra, the pseudo-random output signal of EXCLUSIVE OR gate 24 controls the extent of the angle modulation imposed on the constant amplitude output of modulator 21. The amplitude of the output of modulator 21 is varied in proportion to the magnitude of K by power amplifier 18 so that a high frequency signal transmitted from antenna 19 has variable power, causing the spectral level of the output signal to rise and fall, as if the signal were subjected to ionspheric high frequency fading.

A hostile surveillance receiver in the vicinity of the transmitter of FIG. 1 is therefore not likely to detect the transmitter being in proximity to it. Instead, the hostile surveillance receiver is likely to interpret the transmitter of FIG. 1 as being at a sufficiently great distance from it that the receiver could not join the transmitter. Therefore, the hostile surveillance transmitter is not likely to select the signal derived from the transmitter of FIG. 1 as a jamming target.

Prior to data from source 15 being applied to channel 16 preamble clock and pseudo-random synchronization sequences are directly supplied by clock 12 and PN generator 11 to modulator 21 in a conventional manner, not illustrated. The clock and pseudo-random synchronization sequences enable a clock source and a PN generator in a remote receiver to be synchronized with the signal radiated from the transmitter of FIG. 1.

Figure 2:
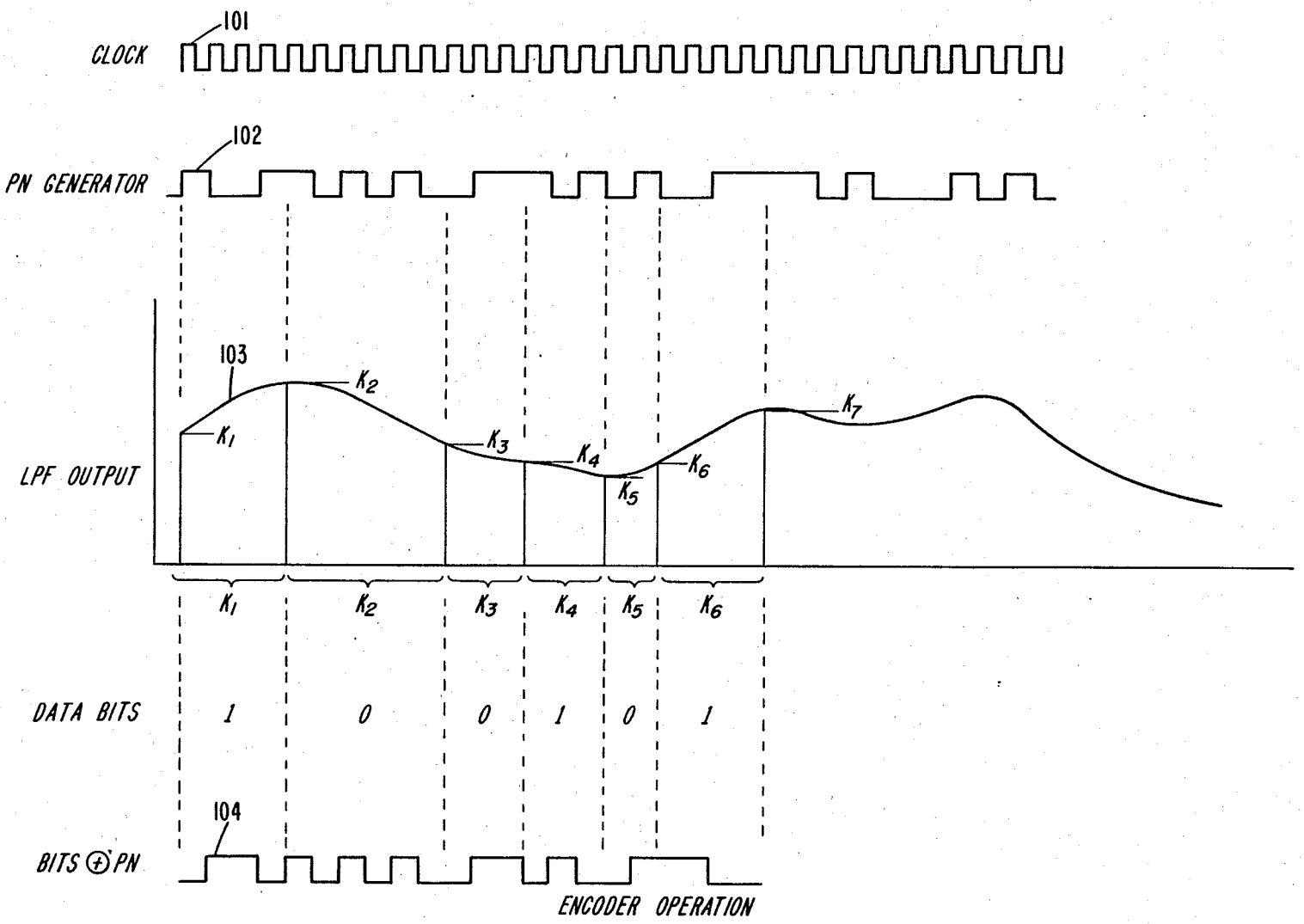
FIG. 2 is a series of waveforms helpful in describing the operation of FIG. 1.

To provide a better and more complete understanding of the transmitter of FIG. 1, reference is now made to the waveforms of FIG. 2, an exemplary, simplified set of waveforms for the operation of the transmitter of FIG. 1. In FIG. 2, the values of K range from two to six. In an actual system, values of K typically vary from 10 to 10,000.

The output signal of clock source 12 is illustrated as being square wave 101. PN generator 11 responds to each positive going transition in wave 101 to derive a chip. Thus, for the first, second, third, and fourth positive going transitions in waveform 101, PN generator 11 derives chips having binary values 1001, as illustrated by bilevel waveform 102 wherein binary one and zero values are respectively represented by high and low levels.

In response to waves 101 and 102, digital low pass filter 13 derives a set of multi-bit, parallel output signals having values indicated by waveform 103. Filter 13 responds to each positive going transition of wave 101 to derive a separate, multi-bit output signal having an amplitude representing low pass filter properties of the output of PN generator 11 assuming a cut-off frequency of 10 Hz, as represented by more than 1,000 cycles of clock source 12. In a typical situation, each multi-bit output of low pass filter 13 includes eight parallel binary bits. The most significant bits in each output of low pass filter 13 are supplied to the buffer register stages in quantizer 14 after K oscillations of clock wave 101 have occurred. In the exemplary situation illustrated in FIG. 2, wherein the output of filter 13 is represented by waveform 103 six intervals are considered; during the six intervals K has values of $K_1=4$, $K_2=6$, $K_3=3$, $K_4=3$, $K_5=2$, and $K_6=4$, as indicated by the value of waveform 104 at the beginning of each interval. Each of these values of K represents the number of cycles of waveform 101 between adjacent samples of the output of digital low pass filter 13.

The values of K determine the number of chips supplied by PN generator 11 to EXCLUSIVE OR gate 24 for each data bit derived from source 15. In the exemplary situation illustrated in FIG. 2, the data bits in interleaver 27 during the six indicated intervals have values of 100101, respectively.

At the beginning of the first illustrated interval $K_1=4$, whereby four clock pulses are supplied by clock 12 to frequency divider or counter 25, during this interval. During the first interval a binary one signal is supplied by interleaver 27 to EXCLUSIVE OR gate 24 and the four chips supplied by PN generator 11 to EXCLUSIVE OR gate 24 have binary values of 1001. The binary one value derived from interleaver 27 during the first interval causes the values of the chips supplied to EXCLUSIVE OR gate 24 by generator 11 to be reversed so that during the first interval EXCLUSIVE OR gate 24 derives an output sequence of 0110 during the first four illustrated cycles of clock waveform 101.

At the beginning of the second illustrated interval, digital low pass filter 13 is supplying a multi-bit binary signal to the buffer register stages in quantizer 14 in accordance with the value $K_2=6$, whereby counter 25 is preset to a value of $K_2=6$. After six cycles of clock source 12 have occurred, an output signal is supplied by clock source 25 to interleaver 27. During this second interval, PN generator 11 supplies six chips having binary values of 101010 to EXCLUSIVE OR gate 24. During this same interval, interleaver 27 supplies a binary zero signal to EXCLUSIVE OR gate 24. EXCLUSIVE OR gate 24 responds to the outputs of PN generator 11 and interleaver 27 during this second interval to derive a binary bit sequence 101010. The operation of interleaver 27 and EXCLUSIVE OR gate 24 continues in this manner for the remaining six illustrated intervals.

Figure 3:
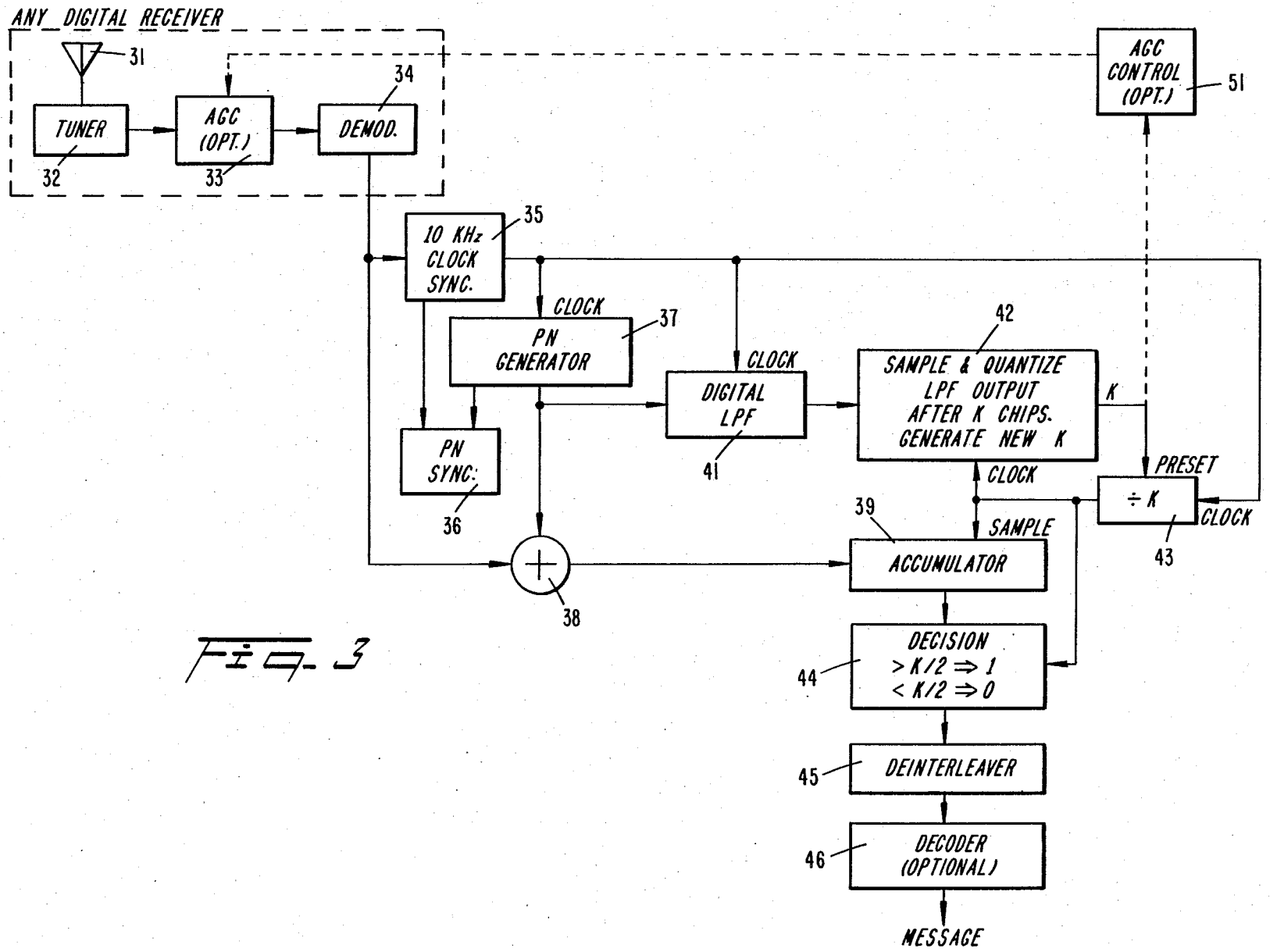
FIG. 3 is a block diagram of a receiver responsive to a signal transmitted from the transmitter of FIG. 1.

Reference is now made to FIG. 3 of the drawing wherein there is illustrated a block diagram of a preferred receiver responsive to the signal transmitted from the transmitter of FIG. 1. The receiver of FIG. 3 includes an antenna 31 which supplies tuner 32 with a replica of the wave transmitted from antenna 19. Tuner 32 derives a high frequency output signal that is coupled to optional automatic gain control stage 33. The gain of automatic gain control circuit 33 is set so that it is inversely proportional to K, whereby a relatively constant amplitude output signal is derived from the AGC circuit. The output signal of AGC circuit 33 is applied to frequency or phase demodulator 34, which derives a serial base band signal that is a replica of the output signal of EXCLUSIVE OR gate 24, FIG. 1. In many situations, it is not necessary to include AGC circuit 33, because demodulator 34 is capable of handling the wide dynamic range of the output of tuner 32, despite the power variations imposed on the output of angle modulator 21 by amplifier 18.

The base band output of demodulator 34 is applied to a conventional synchronized clock source 35 having the same frequency as clock source 12. The resulting 10 kHz output of clock source 35 is applied to conventional pseudo-random number generator synchronizer 36. Clock 35 and synchronizer 36 are synchronized in response to the preamble synchronization signal derived from the transmitter of FIG. 1. Synchronizer 36 controls pseudo-random number generator 37 in a conventional manner so the PN generator is synchronized with chips derived from demodulator 34. PN generator 37 includes a clock input responsive to the output of clock 35 and is constructed identially with PN generator 11 so both PN generators derive identical bit sequences.

The synchronized pseudo-random sequence derived from PN generator 37 is applied to one input of EXCLUSIVE OR gate 38, having a second input responsive to the serial base band signal derived from demodulator 34. EXCLUSIVE OR gate 38, having the same characteristics as EXCLUSIVE OR gate 24, derives a serial binary signal that is applied to a clock input of accumulator 39. In a perfect, noiseless communication link between the transmitter of FIG. 1 and the receiver of FIG. 3, the output of EXCLUSIVE OR gate 38 corresponds with the input of EXCLUSIVE OR gate 24. The contents of accumulator 39 are sampled once for each received data bit, i.e., after K chips have been supplied to and derived from EXCLUSIVE OR gate 38, to enable a decision to be made as to the binary value of the received bit over the last K chips.

To derive a signal indicative of the magnitude of K in the receiver of FIG. 3, to control the gain of AGC circuit 33 and the sampling time of accumulator 39, the output signal of PN generator 37 is applied to a data input of digital low-pass filter 41, having the same characteristics as filter 13. Filter 41 includes a clock input responsive to clock source 35 to derive an eight bit parallel output word once for each cycle of clock 35. The output of filter 41 is applied to quantizer 42, having the same characteristics as quantizer 14; quantizer 14 and 42 are set to the same initial value. Thereby, in response to K output chips of demodulator 34, i.e., K cycles of clock 35, having occurred, quantizer 42 derives a five bit parallel output word. The five bits have the same value as the five most significant bits of the eight parallel output bits of low-pass filter 41 sampled at the completion of K cycles of clock 35 since the last sample. The five bit signal derived by quantizer 42 has a value equal to K.

The output signal of quantizer 42 is applied in parallel as a control input to automatic gain controller 51 for AGC circuit 33 and as an input to presettable down counter 43. Controller 51 includes a digital to analog converter responsive to the multibit output of quantizer 42 for deriving a gain control signal for AGC circuit 33. The AGC circuit 33 responds to the voltage output of controller 51 to vary the amplitude of the signal applied to demodulator 34 in a relatively conventional manner.

The signal supplied by quantizer 42 to down counter 43 sets the maximum count in the down counter. Down counter 43 also includes a decrement or clock input responsive to the output of 10 kHz clock source 38. In response to the number of pulses derived from clock source 38 being equal to K, down counter 43 derives an output signal that is supplied to a clock input of quantizer 42 and to an input of accumulator 39. Quantizer 42 includes a five stage buffer register enabled in response to the output signal of downcounter 43 to sample the five most significant bits of the output of filter 41.

The signal supplied by down counter 43 to accumulator 39 activates the accumulator to derive a parallel multi-bit output word indicative of the accumulated binary values supplied to the accumulator clock input by EXCLUSIVE OR gate 38 during the last K chips derived from demodulator 34. Thereby, accumulator 39 stores K binary bits each time it is sampled in response to the output of counter 43. The K binary bits stored in accumulator 39 at the end of each sampling interval are all equal in value to the value of the binary data bit from data source 15 supplied to EXCLUSIVE OR gate 24 by channel 16 over the interval of K chips from generator 11, assuming a perfect communication link between the transmitter of FIG. 1 and the receiver of FIG. 3.

Because noise is likely to be present in the link between the transmitter of FIG. 1 and the receiver of FIG. 3, decision network 44 responds to the multi-bit parallel output word of quantizer 42 representing K and the sampled parallel multi-bit output of accumulator 39 to provide an indication of the binary value of the decoded data bit derived from gate 38. Decision network 44 includes an algorithm such that binary one and zero values respectively are derived therefrom in response to more than K/2 of the bits derived from accumulator 39 having a one value and in response to less than K/2 of the bits from the accumulator having a value of zero. Each time there is an equal number of ones and zeros derived from accumulator 39 at any one time, decision network 44 alternates between a one and a zero, a result achieved by including a toggle flip-flop in the decision network. The toggle flip-flop is switched between states each time equal numbers of ones and zeros are supplied by accumulator 39 to decision network 44.

The output of decision network 44 is applied to deinterleaver 45, having complementary characteristics to interleaver 27. Deinterleaver 45 derives a binary bit sequence that, under optimum conditions, is an exact replica of the signal supplied to interleaver 27 by coder 26. The output signal of deinterleaver 45 is applied to decoder 46, having characteristics identical to those of coder 26, whereby decoder 46 derives a bit sequence which, under idealized conditions, is a replica of the binary signal derived from register 20.

While the transmitter of FIG. 1 provides the desired fading result under certain circumstances, it has certain disadvantages because each data bit has absolutely the same energy per bit. In particular, the transmitter power is maintained absolutely constant for the duration of one bit and then suddenly changes to a new power level for the next bit. Unless a very large number of discrete power and data bit duration levels are employed, the sudden changes could be employed by an intelligent surveillance receiver to identify the transmitter. In addition, the relationship between bit rate and power level forces an unnatural power versus time relationship for each transmitted bit. The high power, short duration bits are skewed relative to the low power, long duration, faded bits. Thus, there is a tendency for the transmission to be of a burst like nature.

Figure 4:
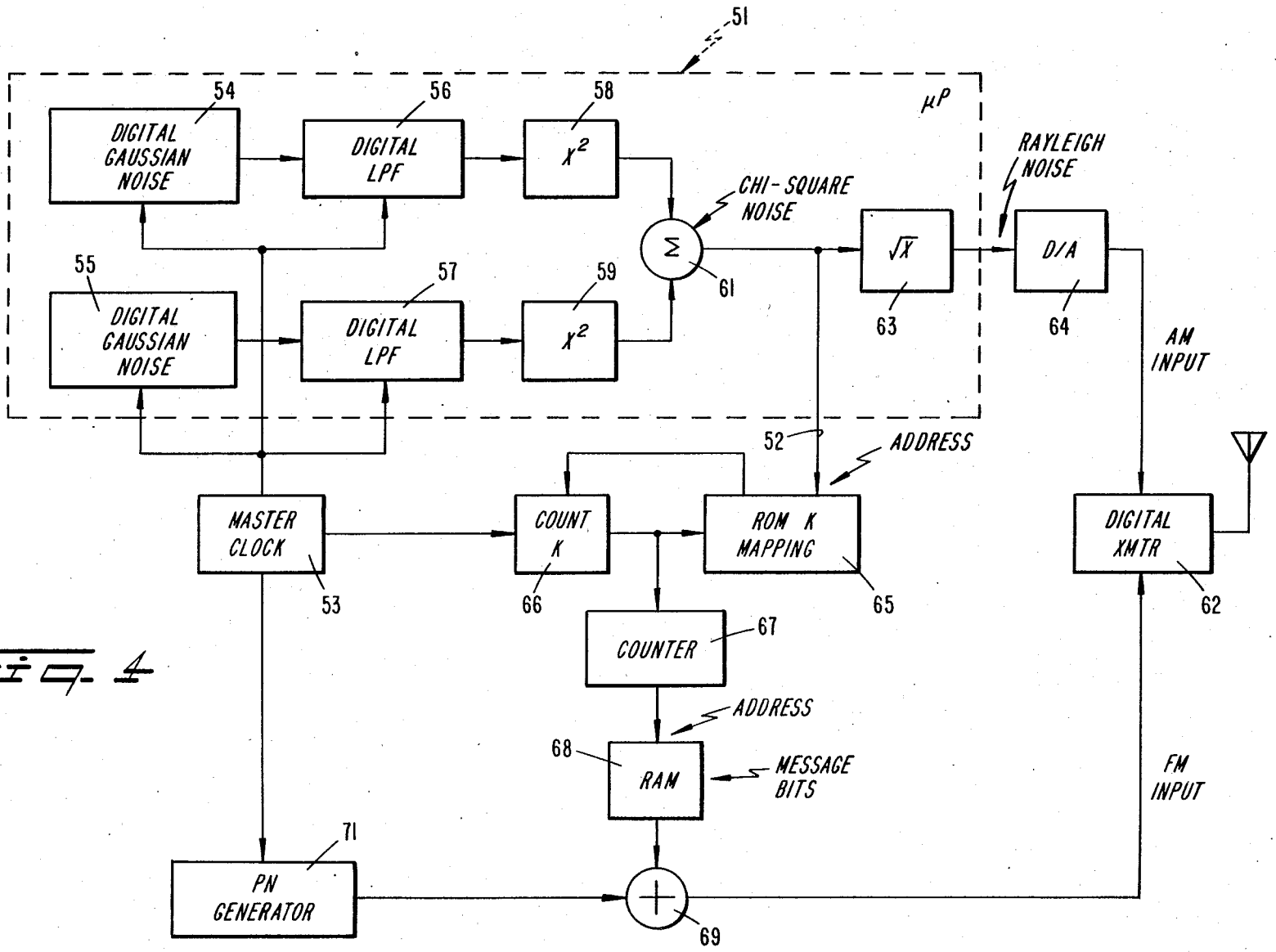
FIG. 4 is a block diagram of a second embodiment of a transmitter in accordance with the invention.

The transmitter of FIG. 4 overcomes these problems by providing minor energy variations during each bit to provide a power density function representing fading. For high frequency transmission, the transmitted power varies as a chi-square noise function. The chi-square noise function also controls the length of each data bit, i.e., the number of chips in the bit. Because the chi-square noise function varies over the duration of a bit, the transmitted power also varies to a slight extent.

The transmitter of FIG. 4 includes digital circuit 51 for deriving a multi-bit digital signal indicative of chi-square noise on lead 52. The signal on lead 52 typically has a variation representing a band width from DC to 1.0–4.0 Hertz. The chi-square noise signal derived on lead 52 has predictable properties, being derived in response to master clock source 53, having a frequency anywhere in the range of 1 to 10 kHz. Master clock 53 controls digital circuit 51 to derive the signal on lead 52.

Circuit 51 can be hard wired or an appropriately programmed microprocessor. In either event, circuit 51 includes two digital Gaussian noise sources 54 and 55, driven by master clock source 53. Digital Gaussian noise sources 54 and 55 respond to the output signal of master clock 53 in a predictable, predetermined manner from an initial starting point. Sources 54 and 55 can be properly programmed read only memories that are successively addressed or clocked in response to each output pulse of clock source 53.

The output signals of digital Gaussian noise sources 54 and 55 are respectively applied to dynamic digital low pass filters 56 and 57, which transform the output signals of the noise generators into digital signals that vary smoothly as a function of time. Filters 56 and 57 simulate first-order approximations for the fading characteristics of a high frequency transmission link. For typical high frequency channels, the cut-off (−3 dB) frequency of filters 56 and 57 is in the range of 0.5 to 2.0 Hertz. To provide realistic simulation of high frequency fading, filters 56 and 57 are responsive to master clock source 53 to change the coefficients of the filter and therefore the band width of the filter. The digital output signals of low pass filters 56 and 57 have a nearly Gaussian probability.

To transform the nearly Gaussian probability of the output signals of filters 56 and 57 into a density function representative of fading, particularly high frequency fading, the output signals of filters 56 and 57 are converted into a digital chi-square noise signal on lead 52. To these ends, the output signals of filters 56 and 57 are respectively applied to digital squaring networks 58 and 59, which derive digital signals that are applied to inputs of digital summing network 61. Digital summing netowrk 61 derives the chi-square noise signal having a density function representing high frequency fading.

The chi-square digital signal derived from summing network 61 can be used as a control for the power derived from angle modulator digital transmitter 62. However, because most angle modulated transmitters employ voltage for controlling the amplitude of transmitted power, the output signal of summing network 61 is generally applied to digital square root circuit 63, which derives a digital signal representing Rayleigh noise content. The digital output signal of square root network 63 is applied to digital to analog converter 64, having an analog output applied to a voltage control input of transmitter 62. The analog Rayleigh noise components applied by converter 64 to the voltage control input of transmitter 62 cause the power derived from transmitter 62 to be amplitude modulated in a band width from zero to 1.0–4.0 Hertz, the same spectrum as is represented by the digital output signal of summing network 61, by virtue of the squaring processes of squaring networks 58 and 59 on the 0.5–2.0 Hertz output signals of filters 56 and 57. The power derived from transmitter 62 has such a variation because the output signal of converter 64 is applied to a voltage input of the transmitter, whereby the voltage and current derived from the transmitter vary with a Rayleigh noise distribution, to provide a chi-square power distribution.

To control the duration of each data bit derived from transmitter 62 so that the duration is related to the amplitude of the chi-square noise distribution at the beginning of a data bit, the signal on lead 52 is applied to an address input of read only memory 65. Read only memory 65 determines the number (K) of digital pseudo noise chips over which a single data bit is transmitted. In one preferred embodiment, the address input on lead 52 to read only memory is related to the output of the memory in accordance with Table I, at the end of the present specification.

To interpret Table I, the magnitude of the signal on lead 52 is, in an exemplary situation, a nine bit binary signal that varies in value from 1 to 512. A value of 1 for the binary signal on lead 52 indicates that the power derived from transmitter 62 during the signal bit is to have a minimum level, having an average of 27.1 dB below maximum level. The duration of the signal bit is, however, much much greater than the duration of a signal bit transmitted at the maximum power level. The energy in a signal bit transmitted at the minimum power level is the same as the energy in a signal bit transmitted at the maximum power level. Thus, the energy of a transmitted data bit derived when a value of one is on lead 52 is the same as the energy level for a data bit derived when a value of 512 is derived on lead 52.

To reduce the memory requirements of read only memory 65 and simplify the circuitry responsive to the output of the read only memory while not significantly affecting the signal derived from transmitter 62, the output signal, K, of the memory has the same value for several different address inputs thereof. For example, in response to address signals on lead 52 having values of 25 and 26, the output of memory 65 has the same value of K=20. Similarly, the output of memory 65 has a minimum value of K=1 for all addresses between 342 and 512. The change in energy between the highest and lowest power data bits derived from transmitter 62 (as respectively represented by values of 512 and 342 on lead 52) for a data bit having a duration of 1 chip is 1.7 dB. The 1.7 dB variation between the maximum and minimum energy levels of a data bit having a duration of 1 chip does not have an adverse effect on the performance of the present invention.

To control the duration of the data bits derived in response to the binary output signal representing K of read only memory 65, the output of the read only memory is supplied as a preset input to preset counter 66, having a count input responsive to the output of master clock source 53. Counter 66 responds to signals from clock source 53, whereby the counter derives an output pulse in response to the number of pulses derived from clock source 53 being equal to the number represented by the signal applied to the preset input of the counter by the output of read only memory 65. The output pulse of counter 66 is applied to a read input of read only memory 65, whereby the memory again responds to the chi-square noise signal on lead 52. Counter 66 is reset to zero simultaneously with the read input of read only memory 65 being enabled, thereby enabling the counter again to start counting pulses from clock source 53 to a level indicated by the value of K derived from the read only memory.

The output pulse of counter 66 is also applied to a clock input of counter 67, which is reset to zero at the beginning of each transmission. Thereby, counter 67 stores a signal indicative of the count of each signal bit to be transmitted; this count remains constant throughout the duration of a signal bit.

The count stored in counter 67 is applied as an address input to random access memory 68, having a write input responsive to binary signal bits, typically from a voice source. The signal bits applied to the write input of random access memory 68 can be processed in a manner similar to that described in connection with the transmitter of FIG. 1, viz: by coding and interleaving, if desired. Random access memory 68 is read out at the addresses indicated by the output of counter 67. The signal data bits are written into successive addresses of random access memory 68. Random access memory 68 includes a parallel to serial output converter for transforming the multi-bit parallel output signal thereof into a serial data stream.

The serial data stream derived from random access memory 68 is applied to one input of EXCLUSIVE OR gate 69, having a second input responsive to the output of digital pseudo noise feedback shift generator 71, in turn responsive to the output of master clock source 53. EXCLUSIVE OR gate 69 responds to the input thereof in the same manner that EXCLUSIVE OR gate 24 responds to the inputs thereof, to supply variable duration binary signal bits to an angle modulated input of angle modulated digital transmitter 62.

Figure 5:
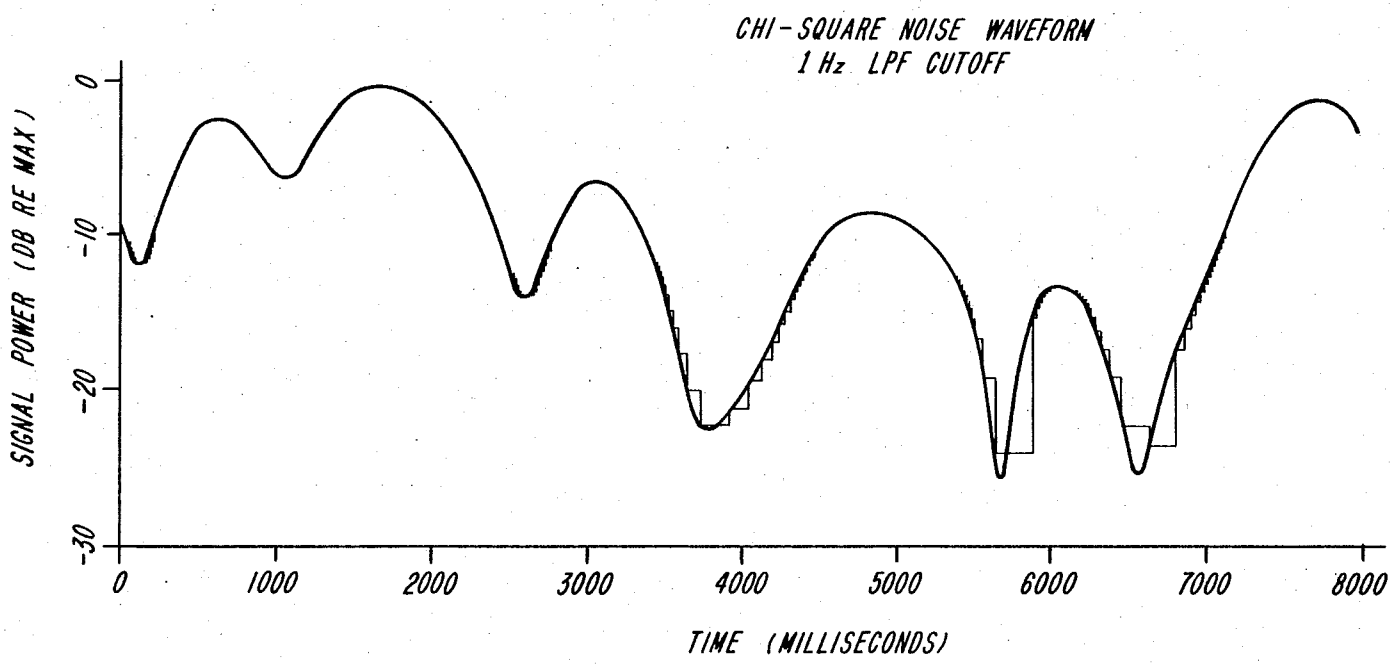
FIG. 5 is a waveform of a typical output of the transmitter of FIG. 4.

FIG. 5 is an illustration of an exemplary power versus time waveform transmitted by digital transmitter 62. In the waveform of FIG. 5, master clock 53 is assumed to have a 1 kHz frequency. The illustrated smooth waveform results from converting the digital Rayleigh noise output of square root network 63 into an analog voltage control input to transmitter 62 by digital to analog converter 64. The stair-step waveform superimposed on the smooth waveform of FIG. 5 indicates the effective duration of each signal bit. The horizontal portion of each stair-step indicates the length of time, i.e., number of chips of PN generator 71, included in each transmitted signal bit. For high power levels each signal bit subsists for only a very few chips, resulting in a very high resolution stair-case. As the power level drops, the number of chips in each signal bit increases, whereby each signal bit has a longer period. At intermediate power levels, the Rayleigh noise distribution remains relatively constant over the interval of a single data bit. At very low power levels, each data bit has a very long period, whereby during the data bit there is a variation in the transmitted power in response to the Rayleigh noise distribution at the voltage input supplied by converter 64 to transmitter 62. While there is a perceptible power change over the duration of one signal bit at the very low power levels, any deleterious effects associated therewith can be accommodated by providing an adequate link margin or employing appropriate error-correcting coding. Because the power smoothly varies, realistic simulation of fading is provided.

Figure 6:
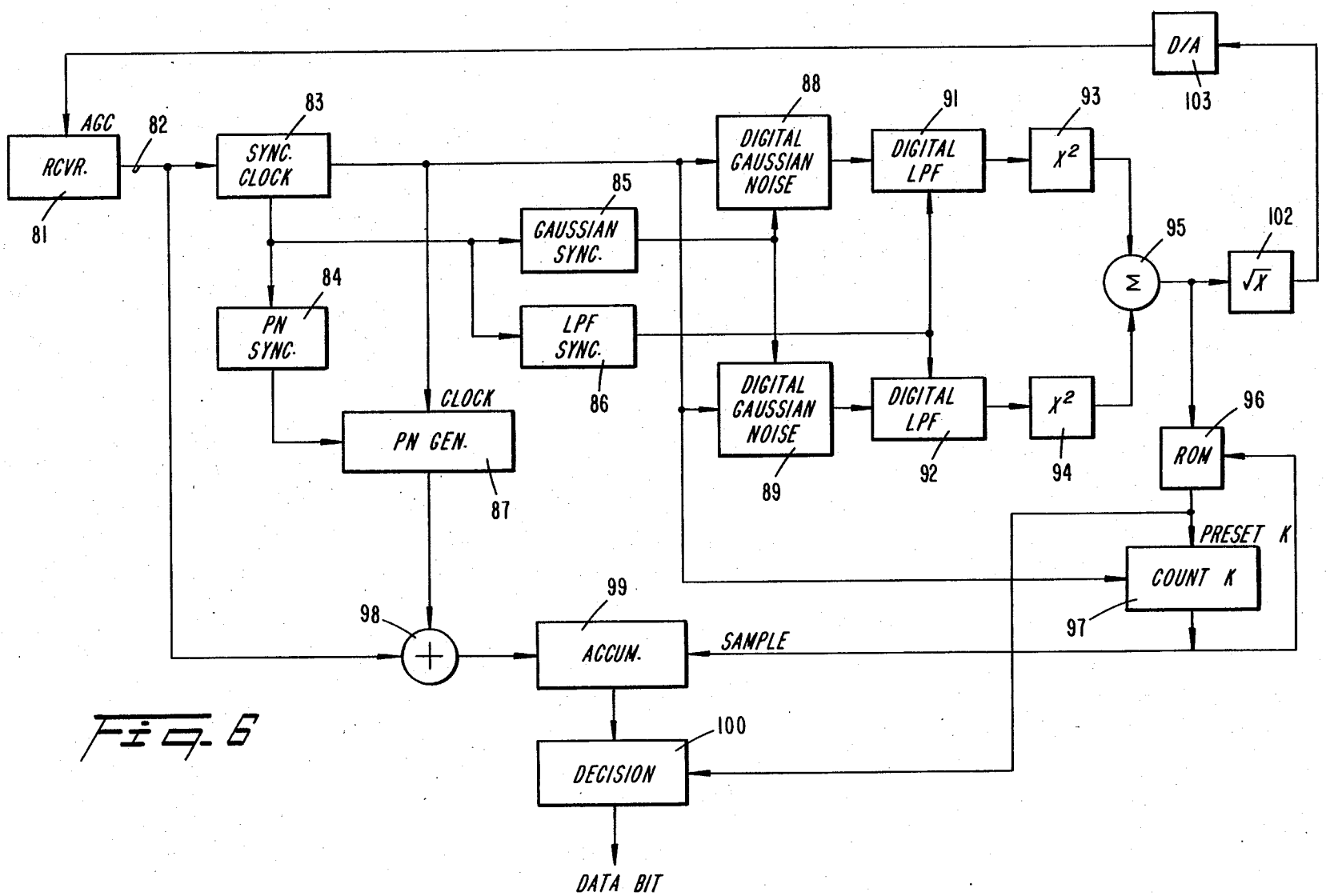
FIG. 6 is a block diagram of a receiver responsive to the transmitter of FIG. 4.

Reference is now made to FIG. 6 of the drawing wherein there is illustrated a receiver responsive to the simulated fading wave derived from the transmitter of FIG. 4. The receiver of FIG. 5 includes conventional digital receiver 81, as illustrated in FIG. 3. Digital receiver 81 may or may not include an automatic gain control stage, as discussed supra. Digital receiver 81 derives a base band output on lead 82; the base band output is applied to conventional synchronized clock source 83, having the same frequency as clock source 53. The resulting output of clock source 83 is applied in parallel to conventional pseudo random number generator synchronizer 84, conventional Gaussian generator synchronizer 85, and conventional dynamic low pass filter synchronizer 86.

Clock 83 and synchronizers 84–86 are synchronized in response to preamble synchronization signals sequentially derived from the transmitter of FIG. 1. Synchronizer 84 controls pseudo-random number generator 87, which derives the same sequence as generator 71 in a conventional manner so the PN generator is synchronized with chips derived from receiver 82, as a result of synchronized clock pulses being derived from source 83 and applied to the clock input of generator 87. Gaussian generator synchronizer 85 applies input signals to synchronization input terminals of digital Gaussian noise generators 88 and 89, having clock inputs responsive to the output of synchronized clock source 83 and which derive sequences identical to the sequences derived from sources 54 and 55. Thereby, the output signals of PN generator 87 and Gaussian noise sources 88 and 89 are respectively identical with the output signals of generator 71 and noise sources 54 and 55 in the transmitter of FIG. 4, except for the propagation delay time of a signal between the transmitter and receiver.

Low pass filter synchronization source 86 supplies input signals to synchronization inputs of dynamic digital low pass filters 91 and 92, having the same characteristics as filters 58 and 59. Filters 91 and 92 include signal input terminals responsive to the output signals of digital Gaussian noise sources 88 and 89, whereby the output signals of low pass filters 91 and 92 are identical with the output signals of low pass filters 56 and 57, except for the propagation delay between the transmitter and receiver. It is necessary to synchronize filters 91 and 92 because of the dynamic nature of the coefficients thereof. The output signals of digital low pass filters 91 and 92 are respectively applied to digital squaring networks 93 and 94, which derive output signals applied to inputs of summing network 95. Summing network 95 derives a chi-square digital noise signal having the same bit sequence as the chi-square noise signal derived by summing network 61, but delayed in time by an amount equal to the propagation time between the transmitter and receiver.

The chi-square noise output signal of summing network 95 is applied to an address input of read only memory 96, having the same characteristics as read only memory 65. Read only memory 96 applies a multi-bit signal to a preset input of counter 97, having a count input responsive to clock pulses derived from source 83. Counter 97 responds to the preset and count inputs thereof to derive a pulse output in response to the number of pulses from clock source 83 being equal to the number of pulses set therein by the output of read only memory 96. Counter 97 is reset to zero each time it derives an output pulse. The output pulse of counter 97 is applied as a read input to read only memory 96, enabling the read only memory to be addressed again in response to the output signal of summing network 95. The period between adjacent output pulses of counter 97 is thus indicative of the duration of each data bit received by receiver 81.

To decode the data bits derived from receiver 81, the signal on lead 82 is applied to one input of EXCLUSIVE OR gate 98, having a second input responsive to the output of PN generator 87. Because PN generator 87 has the same bit sequence as PN generator 71 and the two PN generators are synchronized, the output of EXCLUSIVE OR gate 98 is a replica of the signal bits applied by random access memory 68 to EXCLUSIVE OR gate 69. The output of EXCLUSIVE OR gate 98 is applied to a count input of accumulator 99, having a sample input responsive to each pulse derived from counter 97. Accumulator 99 thus functions in the same manner as accumulator 39 to store K binary bits each time the accumulator is sampled in response to the output of counter 97. The K binary bits stored in accumulator 99 at the end of each sampling interval are all equal in value to the value of the binary data bit from the data source supplying random access memory 68, assuming a perfect communication link between the transmitter of FIG. 4 and the receiver of FIG. 6. Because noise is likely to be present in the link between the transmitter of FIG. 4 and the receiver of FIG. 6, decision network 100 responds to the multi-bit parallel output of read only memory 96 representing K and the sampled parallel multi-bit output of accumulator 99 to provide an indication of the binary value of the decoded data bit derived from gate 98. Decision network 100 functions in the same manner as described with regard to decision network 44. The output signal of decision network 100 can be applied to an interleaver and decoder, if necessary, as discussed in connection with the receiver of FIG. 3.

If the receiver of FIG. 6 includes an AGC network, the chi-square noise signal derived from summing network 95 is applied to digital square root network 102, which derives a digital signal representing Rayleigh noise. The output signal of square root network 102 is applied to digital to analog converter 103, which in turn derives an analog signal having the same amplitude variations as the output of digital to analog converter 64, but time displaced by the propagation time between the transmitter of FIG. 4 and the receiver of FIG. 6. The output signal of converter 103 is applied as an automatic gain control input to receiver 81, to change the gain of the receiver in the same manner as described in connection with the receiver of FIG. 3.

While there have been described and illustrated several specific embodiments of the invention, it will be clear that variations in the details of the embodiments specifically illustrated and described may be made without departing from the true spirit and scope of the invention as defined in the appended claims.

TABLE I

| Power Level (Input Address) | K (Output) | Power dB Relative to Address 512 | Transmitted Energy per Bit | Energy dB Relative to Address 512 |
|---|---|---|---|---|
| 1 | 512 | −27.1 | 512 | 0.0 |
| 2 | 256 | −24.1 | 512 | 0.0 |
| 3 | 171 | −22.3 | 513 | +0.01 |
| 4 | 128 | −21.1 | 512 | 0.0 |

TABLE I-continued

| Power Level (Input Address) | K (Output) | Power dB Relative to Address 512 | Transmitted Energy per Bit | Energy dB Relative to Address 512 |
|---|---|---|---|---|
| 5 | 102 | −20.1 | 510 | −0.02 |
| 6 | 85 | −19.3 | 510 | −0.02 |
| 7 | 73 | −18.6 | 511 | −0.01 |
| 8 | 64 | −18.1 | 512 | 0.0 |
| 9 | 57 | −17.6 | 513 | +0.01 |
| 10 | 51 | −17.1 | 510 | −0.02 |
| 11 | 47 | −16.7 | 517 | +0.04 |
| 12 | 43 | −16.3 | 516 | +0.03 |
| 13 | 39 | −16.0 | 507 | −0.04 |
| 14 | 37 | −15.6 | 518 | +0.05 |
| 15 | 34 | −15.3 | 510 | −0.02 |
| 16 | 32 | −15.1 | 512 | 0.0 |
| 17 | 30 | −14.8 | 510 | −0.02 |
| 18 | 28 | −14.5 | 504 | −0.07 |
| 19 | 27 | −14.3 | 513 | +0.01 |
| 20 | 26 | −14.1 | 520 | +0.07 |
| 21 | 24 | −13.9 | 504 | −0.07 |
| 22 | 23 | −13.7 | 506 | −0.05 |
| 23 | 22 | −13.5 | 506 | −0.05 |
| 24 | 21 | −13.3 | 504 | −0.07 |
| 25-26 | 20 | −13.1--12.9 | 500-520 | −0.10-+0.07 |
| 27 | 19 | −12.8 | 513 | +0.01 |
| 28-29 | 18 | −12.6--12.5 | 504-522 | −0.07-+0.08 |
| 30-31 | 17 | −12.3--12.2 | 510-527 | −0.02-+0.13 |
| 32-33 | 16 | −12.0--11.9 | 512-528 | 0.0-+0.13 |
| 34-35 | 15 | −11.8--11.7 | 510-525 | −0.02-+0.11 |
| 36-37 | 14 | −11.5--11.4 | 504-518 | −0.07-+0.05 |
| 38-40 | 13 | −11.3--11.1 | 494-520 | −0.16-+0.07 |
| 41-44 | 12 | −11.0--10.7 | 492-528 | −0.17-+0.13 |
| 45-48 | 11 | −10.6--10.3 | 495-528 | −0.15-+0.13 |
| 49-53 | 10 | −10.2--9.8 | 490-530 | −0.19-+0.15 |
| 54-60 | 9 | −9.8--9.3 | 486-540 | −0.23-+0.23 |
| 61-68 | 8 | −9.2--8.8 | 488-544 | −0.21-+0.26 |
| 69-78 | 7 | −8.7-8.2 | 483-546 | −0.25-+0.28 |
| 79-93 | 6 | −8.1--7.4 | 474-558 | −0.33-+0.37 |
| 94-113 | 5 | −7.4--6.6 | 470-565 | −0.37-+0.43 |
| 114-146 | 4 | −6.5--5.4 | 456-584 | −0.50-+0.57 |
| 147-204 | 3 | −5.4--4.0 | 441-612 | −0.65-+0.77 |
| 205-341 | 2 | −4.0--1.8 | 410-682 | −0.96-+1.25 |
| 342-512 | 1 | −1.8-0.0 | 342-512 | −1.75-0.0 |

I claim:

1. Apparatus responsive to a data signal for transmitting a wave modulated by the data in the data signal in such a manner that the transmitted wave radiated from a transducer simulates a fading wave, the apparatus comprising predictable noise like generating means, means responsive to the data signal and the generating means for controlling the power level and the rate at which the data are transmitted from the transducer, said controlling means including means responsive to the date signal and the generating means for increasing and decreasing the power level and the rate at which the data are transmitted from the transducer in a like manner and being responsive to the generating means to simulate fading of the wave as transmitted from the transducer.

2. The combination of claim 1 wherein the controlling means includes means for varying the information rate of the data signal as it is radiated from the transducer and the power of the wave as it is radiated from the transducer so the radiated data signal rate and the radiated power are directly proportional to each other.

3. The combination of claim 2 wherein the data signal source is a binary data bit stream, the varying means including means for varying the duration and power level of each bit in the stream in such a manner that each variable duration bit as it is radiated from the transducer has approximately the same energy.

4. The combination of claim 2 wherein the data signal source is a binary data bit stream, the varying means including means for varying the duration and power level during each bit in the stream in such a manner that each variable duration bit as it is radiated from the transducer has approximately the same energy and has power variations representing fading during the bit.

5. The combination of claim 2 wherein the data signal source is a binary data bit stream, the varying means including means for varying the duration and power level during each bit in the stream in such a manner that each variable duration bit as it is radiated from the transducer has approximately the same energy and has power variations simulating fading during the bit.

6. The combination of claim 3 wherein the varying means includes means responsive to the generating means for non-linearly combining each variable duration bit with K equal duration chips determined by the value of chips in the sequence occurring during each variable duration bit, where K is a positive pseudo randomly derived integer varying from two to an integer considerably greater than two.

7. The combination of claim 1 wherein the data signal source is a binary data bit stream, the varying means including means for varying the duration and power level of each bit in the stream in such a manner that each variable duration bit as it is radiated from the transducer has approximately the same energy.

8. The combination of claim 7 wherein the varying means includes means responsive to the generating means for non-linearly combining each variable duration bit with K equal duration chip determined by the value of chips in the sequence occurring during each variable duration bit, where K is a positive pseudo randomly derived integer varying from two to an integer considerably greater than two.

9. The combination of claim 1 wherein the information rate of the data signal as it is radiated from the transducer varies by an amount directly proportional to the level of the power as it is radiated from the transducer in accordance with a predictable noise-like sequence derived by the generating means, the generating means deriving a predictable noise-like sequence having a predetermined chip rate, the controlling means including: an amplifier, means responsive to the generating means for controlling the power of a signal derived by the amplifier in accordance with a first function of the number chips of the sequence over a predetermined period, and means responsive to the generating means and the data signal source for controlling the rate at which data from the data signal source are applied to the amplifier in accordance with a second function of the number of chips of the sequence over a predetermined interval.

10. The combination of claim 9 wherein the first function is such that the transmitted power level varies only slowly as a function of time in a manner similar to changes of a transmitted fading wave.

11. The combination of claim 10 wherein the means for controlling the power of the signal derived from the amplifier includes digital low pass filter means responsive to the generator for deriving an amplifier control signal having a value that is an integral submultiple of the binary value of the number of chips in the sequence over the predetermined period.

12. The combination of claim 10 wherein the means for controlling the power of the signal derived from the amplifier includes digital low pass filter means responsive to the generator for deriving an amplifier control signal having a value that is related to the number of chips in the sequence over the predetermined period and selectively changes during the predetermined period.

13. The combination of claim 9 wherein the means for controlling the data rate includes EXCLUSIVE OR means having a first input and a second input, the second input being responsive to a sequence derived by the generating means responsive to the generating means and the data source for supplying bits of data from the source to the first input of the EXCLUSIVE OR means at a rate that is an integral sub-multiple of the chip rate of the sequence over the predetermined interval, said last named means including low pass filter means responsive to the generator for controlling the value of the sub-multiple, the EXCLUSIVE OR means deriving an output respectively having first and second values in response to the first and second inputs thereof having the same and different values, and means for coupling the output of the EXCLUSIVE OR means to a signal input of the power amplifier.

14. The combination of claim 13 wherein the low pass filter means includes means for deriving a signal indicative of the number, K, of chips of the sequence for each bit of the data singal over the predetermined time, where K is a positive integer greater than one, a counter responsive to the signal indicative of K set to have a maximum count indicative of K and connected to be incremented in response to the derivation of each chip in the sequence to derive an output in response to the number of bits in the sequence being equal to K, and means for supplying a data bit to the EXCLUSIVE OR means each time an output is derived from the counter.

15. The combination of claim 14 wherein the generator includes a pseudo-noise source and the low pass filter means includes a digital low pass filter, and means for sampling and quantizing an output signal of the digital low pass filter in response to the counter reaching a count of K, the sampling and quantizing means controlling the value of K.

16. The combination of claim 14 wherein the generator includes a digital Gaussian noise source means and the low pass filter means includes dynamic digital low pass filter means, means responsive to the dynamic digital low pass filter means for deriving a digital signal representing chi-square noise, a read only memory connected to be addressed by the signal representing chi-square noise and read in response to the counter reaching a count of K, the read only memory controlling the value of K.

17. The combination of claim 9 wherein the data source is a binary data bit stream and the predictable noise-like function varies over the duration of a data bit in the stream to vary the power of the signal derived by the amplifier over a bit in the stream.

18. A data communication method for transmitting data from a location so that the communication is disguised from a receiver in the vicinity of the location as a fading wave from a remote source comprising the steps of randomly modulating a wave in response to the data and a predictable noise-like function that power modulates the wave to simulate fading, transmitting the wave from the location, the wave as transmitted from the location being disguised as the fading wave, receiving the transmitted wave at a site remote from the location to derive a received signal, and demodulating the received signal by operating on it in a manner related to the predictable noise-like function that power modulates the wave to simulate fading to derive a replica of the data.

19. The method of claim 18 wherein the transmitted wave is derived by modulating both the data information rate of the transmitted wave and the power level of the transmitted wave in accordance with the noise-like function, the noise-like function modulating the rate and the power so the information rate and the tramsmitted power of the transmitted wave increase and decrease together.

20. The method of claim 19 wherein the data are in a binary data bit stream, the bits of the stream in the transmitted wave having variable duration and variable power level so each bit in the transmitted wave has approximately the same energy.

21. The method of claim 18 wherein the data are in a binary data bit stream, the bits of the stream in the transmitted wave having variable duration and variable power level so each bit in the transmitted wave has approximately the same energy with noise-like power variations that simulate fading during the bit.

22. A transmitter responsive to a source of data bits comprising a generator for deriving a predictable noise-like sequence having a predetermined chip rate, means responsive to the generator for deriving a signal indicative of the number, K, of chips of the sequence for each data bit, where K is a real integer greater than one, means responsive to the generator and the signal indicative of K for clocking a data bit from the source each time the number of chips in the sequence equals K, and transmitter means responsive to the data bits clocked by the clocking means and the signal indicative of K for deriving an angle modulated wave having a modulation angle controlled by the clocked bits and having a variable power level controlled by the value of the sequence during the K chips.

23. The transmitter of claim 22 wherein the variable power level is a noise-like function representing fading and selectively changes during a transmitted data bit.

24. The transmitter of claim 22 further including EXCLUSIVE OR gate means responsive to the clocked data bits and the sequence for deriving an output signal having first and second values respectively responsive to the clocked data bits and the bits of the sequence having the same and differing values, the value of K varying so it is one or an integral sub-multiple of the number of chips derived from the sequence in a predetermined interval, the output signal being supplied to the transmitter means to angle modulate the wave.

25. A receiver for a wave angle modulated at a transmitter by binary data bits, the binary data bits and a predictable noise-like sequence at the transmitter controlling the occurrence rate of binary information bits supplied to the receiver, comprising means for demodulating the wave to derive a base band replica of the binary information bits with an occurrence rate determined by the sequence, a predictable noise-like sequence generator, means for synchronizing the generator to the base band replica to derive a synchronized predictable noise-like sequence, EXCLUSIVE OR means responsive to the synchronized sequence and the base band replica for deriving a first signal, a clock source synchronized with chips forming information bits of the received angle modulated wave, means responsive to the synchronized sequence and the clock source for deriving a second signal having a value indicative of the length of each binary information bit, and decision means responsive to the first signal for a period determined by the value of the second signal for deriving a replica of the binary data bits.

26. The receiver of claim 25 wherein the received angle modulated wave has a variable amplitude related to the occurrence rate of the binary data bits modulated on the wave, and further including means for varying the amplitude of the received angle modulated wave in response to a signal controlling the value of the second signal.

27. The method of claim 18 wherein the transmitted wave has a predetermined carrier frequency that is randomly modulated by the data.

28. The method of claim 27 wherein the transmitted carrier frequency is in the 3–30 MHz range and the transmitted wave is derived by varying the data information rate of a signal controlling the transmitted wave and varying the power level of the transmitted wave so the information rate and the power of the transmitted wave increase and decrease together.

29. A transmitter responsive to a source of data bits comprising a generator for deriving a predictable noise-like sequence having a predetermined chip rate, means responsive to the generator for deriving a signal indicative of the number, K, of chips of the sequence for each data bit, where K is a real integer greater than one, responsive to the generator and the signal indicative of K for clocking a data bit from the source each time the number of chips in the sequence equals K, and transmitter means responsive to the generator and the data bits clocked by the clocking means for deriving an angle modulated wave having a modulation angle controlled by the clocked bits and having a variable power level controlled by the value of the sequence during the K chips.

30. The transmitter of claim 29 wherein the means for deriving a signal indicative of K includes means responsive to the generator for indicating that K oscillations from a clock source in the generator have elapsed.

31. The transmitter of claim 30 wherein the means for deriving a signal indicative of K includes signal processing means responsive to the generator, the signal processing means responding to the generator to determine the value of K.

32. The transmitter of claim 31 wherein the means for deriving a signal indicative of K includes a variable preset counter having a first input responsive to the clock, the signal processing means including means responsive to the generator for presetting a count of K in the preset counter.

33. The transmitter of claim 32 further including memory means for storing bits indicative of the binary data stream, means for controlling read out of the memory means in response to each value of K being reached by the preset counter.

34. The transmitter of claim 33 wherein the signal processing means includes memory means addressed in response to the generator and a count of K being reached by the preset counter.

35. The receiver of claim 36 wherein the second signal deriving means includes a variable preset counter having a clock input responsive to the clock source and which is preset for each binary information bit, means responsive to the clock source for presetting the preset counter to a value commensurate with the number of chips in the information bits.

36. The receiver of claim 35 wherein the amplitude varying means includes means responsive to the presetting means for controlling the gain of an amplifier for the received wave in response to a signal indicative of the preset value.

37. The receiver of claim 36 further including means responsive to the clock source for deriving another predictable noise-like sequence for deriving the signal controlling the value of the second signal, the amplitude varying means being responsive to the sequence deriving means.

38. The receiver of claim 25 further including means responsive to the clock source for deriving another predictable noise-like sequence for deriving the signal controlling the value of the second signal.

39. The receiver of claim 38 wherein the second signal deriving means includes a variable preset counter having a clock input responsive to the clock source and which is preset for each binary information bit, means responsive to the clock source for presetting the preset counter to a value commensurate with the number of chips in the information bits.

40. The receiver of claim 25 wherein the second signal deriving means includes a variable preset counter having a clock input responsive to the clock source and which is preset for each binary information bit, means responsive to the clock source for presetting the preset counter to a value commensurate with the number of chips in the information bits.

41. Apparatus for emitting a modulated information wave that simulates fading, said apparatus being responsive to a stream of binary data bits, the apparatus comprising a predictable noise-like binary chip sequence generating means, a digital angle modulated wave transmitter, means responsive to the generating means for controlling the power level of the wave transmitted from the transmitter, means responsive to the stream of binary bits and the generating means for controlling angle modulation of the transmitted wave, said angle modulation control means including means for controlling the length of each data bit of the transmitted wave in response to a predetermined function of an output of the means for generating, the means for generating controlling the length controlling means and the power level controlling means so the power level and the length of each data bit in the transmitted wave vary in opposite directions to simulate fading of the transmitted wave.

42. The apparatus of claim 41 wherein the angle modulation control means includes means for controlling each data bit in the transmitted wave so it has binary value transitions dependent upon the value of the data bits in the binary stream and the value of chips in the sequence during the data bit.

43. The apparatus of claim 42 wherein the means for controlling each data bit in the transmitted wave includes memory means for storing the value of a bit in the stream for the duration of a data bit in the transmitted wave, and EXCLUSIVE OR means responsive to the bit value in the storing means and the values of chips in a sequence of the generating means during the length of the bit value in the transmitted wave.

44. The apparatus of claim 43 wherein the means for controlling the length of each data bit includes a variable preset counter having a preset value responsive to a function of the value of a chip sequence of the generating means.

45. The apparatus of claim 44 wherein the length controlling means includes means reaponsive to a chip sequence of the generating means for enabling the preset value to be changed upon completion of the length of each bit value in the transmitted wave, the variable preset counter having an output for controlling the application of bits in the stream to the EXCLUSIVE OR means.

46. The apparatus of claim 41 wherein the means for controlling the length of each data bit includes a variable preset counter having a preset value responsive to a function of the value of a chip sequence of the generating means.

47. The apparatus of claim 46 wherein the length controlling means includes means responsive to a chip sequence of the generating means for enabling the preset value to be changed upon completion of the length of each bit value in the transmitted wave.

48. The apparatus of claim 47 wherein the power level controlling means includes means responsive to a chip sequence of the generating means for varying the power level while the preset value is maintained constant.

49. The apparatus of claim 41 wherein the means for generating controls the power level controlling means so that the power of the transmitted wave is varied during data bits of the transmitted wave.

50. The apparatus of claim 41 wherein the means for generating controls the power level controlling means and the length controlling means so the energy of each data bit of the transmitted wave is approximately the same.

51. The apparatus of claim 50 wherein the angle modulation control means includes means for controlling each data bit in the transmitted wave so it has binary value transitions dependent upon the value of the data bit in the binary stream and the value of chips in the sequence during the data bit.

52. The apparatus of claim 51 wherein the means for controlling each data bit in the transmitted wave includes memory means for storing the value of a bit in the stream for the duration of a data bit in the transmitted wave, and EXCLUSIVE OR means responsive to the bit value in the storing means and the values of chips in a sequence of the generating means during the length of the bit value in the transmitted wave.

53. The apparatus of claim 52 wherein the means for controlling the length of each data bit includes a variable preset counter having a preset input responsive to a function of the value of a chip sequence of the generating means.

54. The apparatus of claim 53 wherein the length controlling means includes means responsive to a chip sequence of the generating means for enabling the preset value to be changed upon completion of the length of each bit value in the transmitted wave, the variable preset counter having an output for controlling the application of bits in the stream to the EXCLUSIVE OR means.

* * * * *